US011678715B2

(12) United States Patent
Walsh et al.

(10) Patent No.: US 11,678,715 B2
(45) **Date of Patent: *Jun. 20, 2023**

(54) HEAT RESISTANT ATHLETIC SHOE INSOLE AND OUTSOLE

(71) Applicant: Turformance Sports, LLC, Paramus, NJ (US)

(72) Inventors: William Walsh, Santa Monica, CA (US); Craig Krzyskowski, Austin, TX (US); John E. Brovsky, Lakewood, CO (US)

(73) Assignee: Turformance Sports, LLC, Paramus, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/234,900

(22) Filed: Apr. 20, 2021

(65) Prior Publication Data

US 2021/0307451 A1 Oct. 7, 2021

Related U.S. Application Data

(63) Continuation of application No. 14/777,366, filed as application No. PCT/US2014/030807 on Mar. 17, 2014, now Pat. No. 11,019,878.

(Continued)

(51) Int. Cl.

*A43B 7/00* (2006.01)
*A43B 7/34* (2006.01)

(Continued)

(52) U.S. Cl.

CPC ..... *A43B 7/34* (2013.01); *A43B 1/00* (2013.01); *A43B 5/00* (2013.01); *A43B 7/005* (2013.01);

(Continued)

(58) Field of Classification Search

CPC .. A43B 1/00; A43B 5/00; A43B 7/005; A43B 7/34; A43B 13/125; A43B 17/006

(Continued)

(56) References Cited

U.S. PATENT DOCUMENTS 1,125,134 A 1/1915 Lee
3,624,930 A 12/1971 Johnson et al.

(Continued)

OTHER PUBLICATIONS

PCT/US2014/030807 International Search Report and Written Opinion, dated Aug. 15, 2014.

*Primary Examiner* — Sharon M Prange
(74) *Attorney, Agent, or Firm* — Lippes Mathias LLP

(57) ABSTRACT

An insole and/or outsole for a shoe such as an athletic shoe or cleat that includes a multilayer channeled assembly designed at preventing the transfer of heat from extremely hot ground surfaces, most notably synthetic turf, to the foot. In one embodiment, the insole includes a channeled layer of solid material with a very low thermal conductivity, preferably silicon or cork, as the base material beneath a layer of heat resistant felt preferably made of oxidized polyacrylonitrile fibers. The channeling in the base layer allows for air pockets to be created within the insole itself that makes the heat resistant felt more resistant to (i.e., more efficient at preventing) the transfer of heat. In another embodiment, the outsole for a shoe such as an athletic shoe or cleat includes a base layer of channeled solid material with low thermal conductivity, preferably silicon, cork, or polystyrene, below a layer of heat resistant felt preferably made of oxidized polyacrylonitrile fibers. This assembly is encased within a solid plastic mold that extends up to the base of the upper of the shoe or cleat and allows for little or no pressure to be put on the assembly itself. The studs for the cleats are preferably molded out of the plastic encasing itself.

18 Claims, 4 Drawing Sheets

Related U.S. Application Data

(60) Provisional application No. 61/800,055, filed on Mar. 15, 2013.

(51) Int. Cl.

| | |
|---|---|
| ***A43B 17/00*** | (2006.01) |
| ***A43B 13/38*** | (2006.01) |
| ***A43B 13/12*** | (2006.01) |
| ***A43B 1/00*** | (2006.01) |
| ***A43B 5/00*** | (2022.01) |

(52) U.S. Cl.
CPC ..... *A43B 13/122* (2013.01); *A43B 13/127* (2013.01); *A43B 13/386* (2013.01); *A43B 17/006* (2013.01)

(58) Field of Classification Search
USPC ..... 36/26, 30 R, 44, 128
See application file for complete search history.

(56) References Cited

U.S. PATENT DOCUMENTS

| | | | | |
|---|---|---|---|---|
| 4,005,532 | A | 2/1977 | Giese et al. | |
| 4,887,368 | A | 12/1989 | Latzke | |
| 5,584,130 | A | 12/1996 | Perron | |
| 5,845,418 | A | 12/1998 | Chi | |
| 6,199,304 | B1 | 3/2001 | Ludemann | |
| 8,424,222 | B2 * | 4/2013 | Sulak | A43B 7/144 36/181 |
| 8,950,089 | B2 * | 2/2015 | Youngs | A43B 13/12 36/137 |
| 2006/0130367 | A1 | 6/2006 | Liu | |
| 2009/0178299 | A1 | 7/2009 | Lafortune | |
| 2010/0282433 | A1 | 11/2010 | Blackford | |
| 2011/0104466 | A1 * | 5/2011 | Atkinson | D04H 1/70 442/199 |
| 2011/0203783 | A1 * | 8/2011 | Blackford | A41D 27/08 165/185 |
| 2012/0144794 | A1 | 6/2012 | Ke | |
| 2012/0306164 | A1 | 12/2012 | Contreras et al. | |
| 2014/0007461 | A1 | 1/2014 | Carbo, Jr. et al. | |

* cited by examiner

HEAT RESISTANT ATHLETIC SHOE INSOLE AND OUTSOLE

This application is a continuation and claims the priority benefit of pending U.S. application Ser. No. 14/777,366, filed Sep. 15, 2015, which is the national entry filing of PCT/US14/30807, filed Mar. 17, 2014, which claims the priority benefit of U.S. provisional application Ser. No. 61/800,055, filed Mar. 15, 2013.

BACKGROUND

It is well documented in various studies (Penn State, BYU, EHP, HC) that artificial synthetic turf is significantly hotter than natural dirt and grass. In a study conducted at BYU in June 2002, results found that synthetic turf was 37° F. hotter than asphalt and 86.5° F. hotter than natural grass under similar environmental conditions. The average air temperature on the day of the study was 81.42° F. and the temperature of the turf reached 157° F. On the same day, the natural grass only reached a maximum temperature of 88.5° F. On a hot summer day during peak hours, the surface temperature of synthetic turf can reach over 200° F., according to the same study. A UNLV study also documents excessive surface temperatures of synthetic turf well into October and November (112.4° F., 32.4° F. higher than the air temperature). The study concluded that surface temperature of turf is affected more by the amount of direct sunlight than air temperature, which explains why even in colder months synthetic turf can be extremely hot.

According to various studies (EHP, HC), any temperature above 122° F. can burn skin in less than 10 minutes. Thus, it is generally accepted that playing on synthetic turf fields is potentially dangerous when the surface temperature exceeds 122° F. With the growing number of synthetic turf fields, the issue of a safe and comfortable playing environment becomes a major issue.

It is well documented in professional sports that athletes have complained of blistering and burned feet from playing on synthetic turf.

In 2007, Sports Illustrated reported six Peruvian soccer players from Sporting Cristal were unable to train because of burns and blisters suffered from hot turf fields. According to a 2010 ESPN article, it was believed that heat from turf caused a teammate's injury.

Solutions have been proposed to counteract the heat of the artificial turf, such as watering the fields and changing the material of the turf itself, but all proposed solutions are either not feasible or have failed. In the BYU study, when the turf field was watered, the temperature immediately dropped from 174° F. to 85° F., but within five minutes it rebounded quickly to 120° F. and within 20 minutes it was back up to 164° F. The method of watering a hot turf field is both expensive and ineffective. Another proposed solution of changing the materials within the turf was tested, but the Penn State study concluded that the drop was at most 10° F. At temperatures still exceeding 150° F., these changes offer virtually no advantage.

SUMMARY

The present disclosure describes an insole and/or outsole (a portion of a shoe) as viable solutions to the problem, for example, of athletes playing on hot turf as well as any person whose feet come in contact with other hot surfaces, such as asphalt or cement.

A shoe portion includes a first layer of heat resistant material and a second layer beneath the first layer and made at least in part of a material having a low thermal conductivity and including plural channels on one of a first and second surfaces thereof, the channels separated from one another and creating air space therein.

The channels face downwardly away from the first layer.

The channels have a curvilinear or serpentine configuration.

The heat resistant material first layer is a felt.

The felt includes fibers for limiting heat transfer, and in one embodiment include oxidized polyacrylonitrile fibers.

The channels extend inwardly from the second surface which is a lower surface of the second layer, and the channels extend inwardly from the second surface toward the first surface of the second layer by a dimension of approximately one-half of a total thickness of the second layer.

The first surface of the second layer is an unbroken, continuous surface.

The first and second layers have a same perimeter outline.

The first and second layers form an insole of the shoe, or alternatively the first and second layers form a portion of an outsole of the shoe, or both the insole and the outsole include the first and second layers.

DETAILED DESCRIPTION

Figure 1:
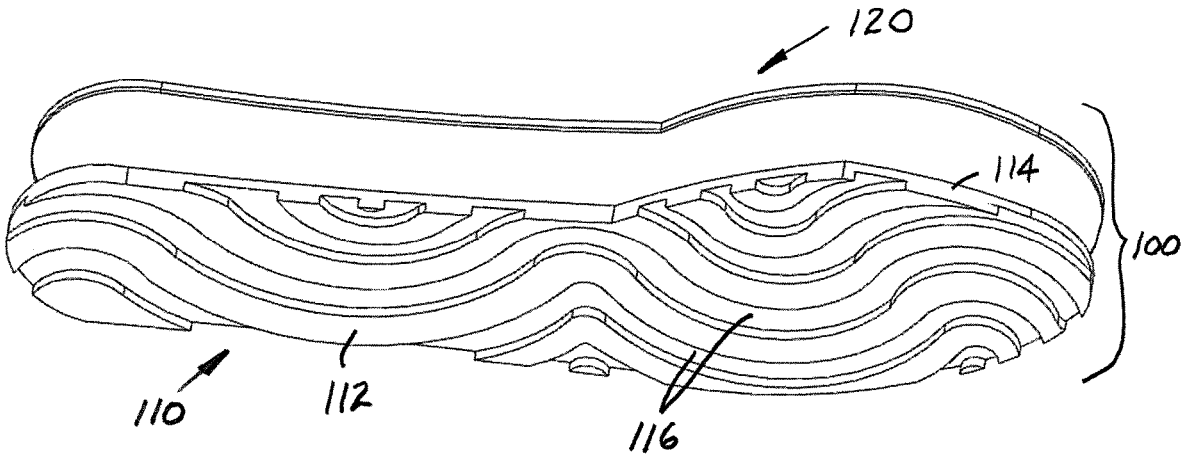
FIGS. 1-3 illustrate exploded views (bottom, top, and bottom, respectively) of an insole of the present disclosure.

This disclosure minimizes the transfer of heat from hot ground surfaces to the foot. Because heat transfer occurs much more efficiently through two solid objects that touch one another and much less efficiently through two objects that are separated by air, it is advantageous to create as much airspace between the foot and the ground as possible. It is also advantageous to have a heat resistant assembly at the point a foot makes contact with an insole as well as where the shoe comes into contact with the hot ground surface. Thus, an effective insole and outsole that minimize conductive heat transfer would drastically reduce the amount of heat passed to the foot from a hot ground surface.

In a preferred form of the insole, the base material is made of a solid substance that has a particularly low thermal conductivity, such as silicon or cork. A material with a low thermal conductivity is necessary because the lower the thermal conductivity is, the less efficiently that material gets hot. The base material of the insole must also be durable enough to support constant wear from anyone using the insole in a shoe.

This base material of the insole is lined with curved channels or grooves that create air space within the insole. These channels face downwardly so that the design minimizes the surface area of the base material that actually comes in contact with the hot surface below it. Because these downward facing channels create air space within the insole itself, it drastically reduces the conductive heat transfer that has to be counteracted. Therefore, this model changes the mode of heat transfer from conductive to radiant in the spaces within the channels. Conductive heat transfer is by far the most efficient form of heat transfer (i.e. heat passes the easiest between two objects in direct contact), so it is advantageous to create as much airspace as possible between the two objects (in this case, the foot and the hot ground surface), to reduce the amount of heat transferred to the foot.

A layer of heat resistant felt is placed above the channeled layer of base material in the insole. This felt, preferably made of oxidized PAN (polyacrylonitrile) fibers, must be particularly effective at preventing the transfer of heat. PAN is a synthetic, semi-crystalline organic polymer resin. When oxidized, PAN is thermally stable and will not melt, burn, soften or drip. Oxidized PAN fibers are used by an array of companies and manufacturers who specialize in heat and flame resistant products. The nature of oxidized PAN fibers makes them a preferred material to be layered above the channeled solid layer as the oxidized PAN fibers aid in the prevention of heat transfer to the foot from a hot ground surface.

A similar channeled solid layer and heat resistant felt assembly is used in the outsole of an athletic shoe or cleat. By creating a heat resistant assembly within the outsole, the problem of heat transfer to the foot is combated at its source (contact with the ground). The outsole has a thin base layer of durable, solid plastic that extends the length of the shoe, of which the studs for the cleat are molded. The top of the plastic mold has walls that extend up to the base of the upper of the shoe, which separates the plastic from the upper, and a layer of plastic above this that extends the length of the outsole. This top layer of plastic acts as support for the upper of the shoe and prevents pressure from being put on the heat resistant assembly itself. This creates a hollow space within the plastic mold, for example about ¼" in height, that runs along the length of the shoe. Inside this space is the assembly of a downward facing channeled solid layer, preferably silicon, beneath a layer of heat resistant felt, preferably oxidized PAN fibers. Because this assembly is encased in a shell of thin plastic, it reduces virtually all pressure that would be put on it by the foot and allows for more efficient insulation.

Figure 2:
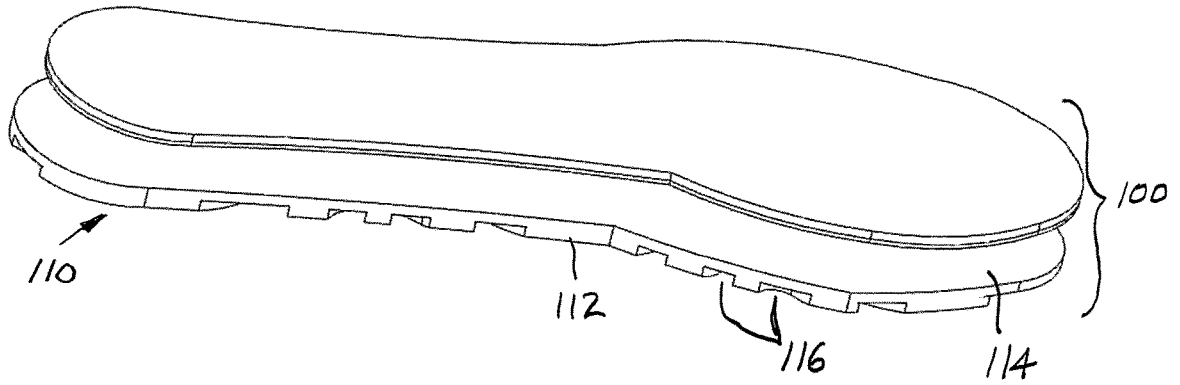
Figure 3:
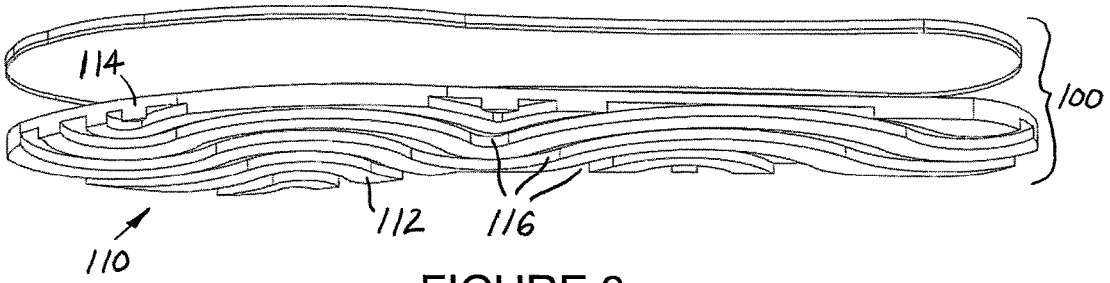

An insole or insole assembly 100 is shown in FIGS. 1-3. The insole includes a first layer 110 is provided above the sole of an athletic shoe (not shown). The insole 100 may be integrated into the sole assembly or may be formed as a separate component that may be advantageously inserted and removed from the athletic shoe by the user. Preferably the first layer 110 extends over an entirety of the sole and has a perimeter configuration akin to a footprint. The first layer is preferably a solid material with a very low thermal conductivity, preferably silicon or cork as will be described further below. The first layer 110 includes a generally planar first or lower surface 112 that faces toward the ground surface. A generally planar second or upper surface 114 is substantially parallel to the first surface 112, i.e., the insole has a substantially constant thickness. The first and second surfaces are spaced apart for example by a dimension ranging between 3/16" and ⅜", and more preferably on the order ¼", although other dimensions may be used without departing from the scope and intent of the present disclosure.

As evident in FIGS. 1-3, the first surface 112 has one or more grooves 116 that extend partially through the thickness of the first layer 110. The grooves 116 have a width ranging from 1/10" and ⅙", and more preferably on the order ⅛". The depth of the grooves 116 is approximately half the thickness of first layer 110, preferably ⅛". The grooves 116 on surface 112 are spaced apart by a dimension, for example, ranging between 1/10" and ⅙", and more preferably on the order ⅛". The second surface 114 is preferably an unbroken, smooth continuous surface.

The insole 100 also preferably includes a second layer 120 that is provided above first layer 110. Preferably the second layer 120 extends over an entirety of the first layer 110 and has the same perimeter or outline as the first layer. The second layer 120 is preferably a heat resistant felt made of oxidized PAN (polyacrylonitrile) fibers with a thickness ranging between ⅛" and ⅓" and more preferably on the order ¼".

Figure 4:
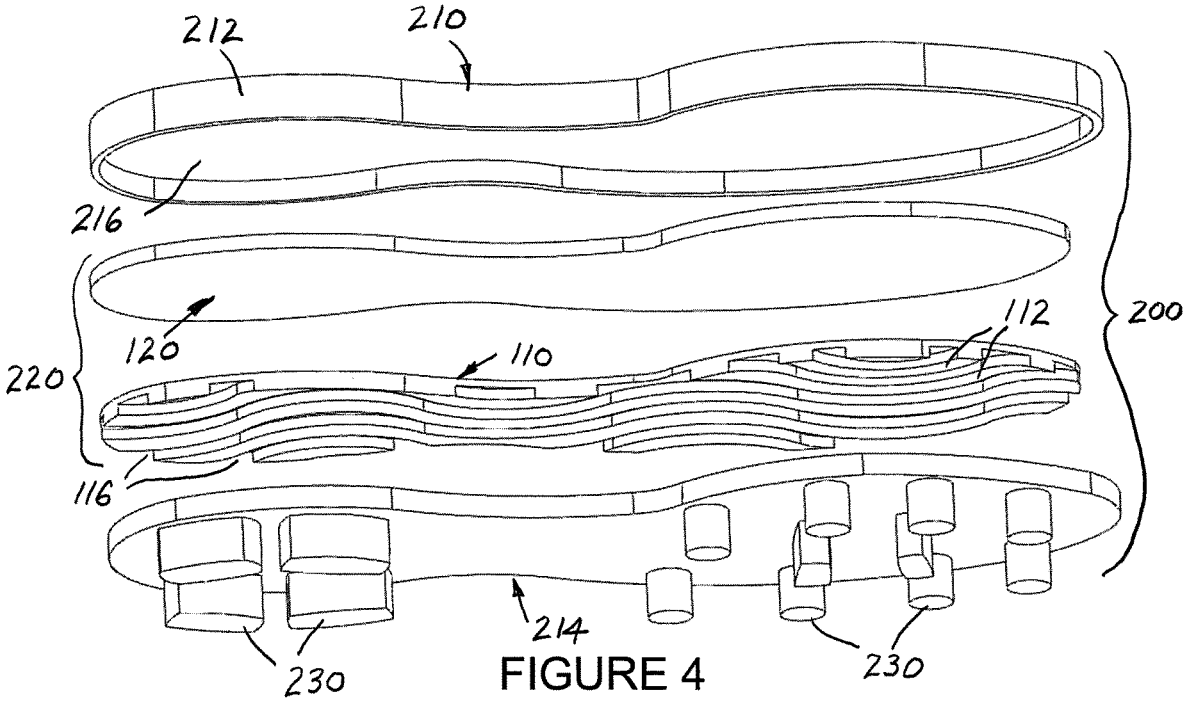
FIGS. 4-6 illustrate exploded views (bottom, top, and bottom, respectively) of an outsole (that incorporates the insole assembly of FIGS. 1-3) of the present disclosure.
Figure 5:
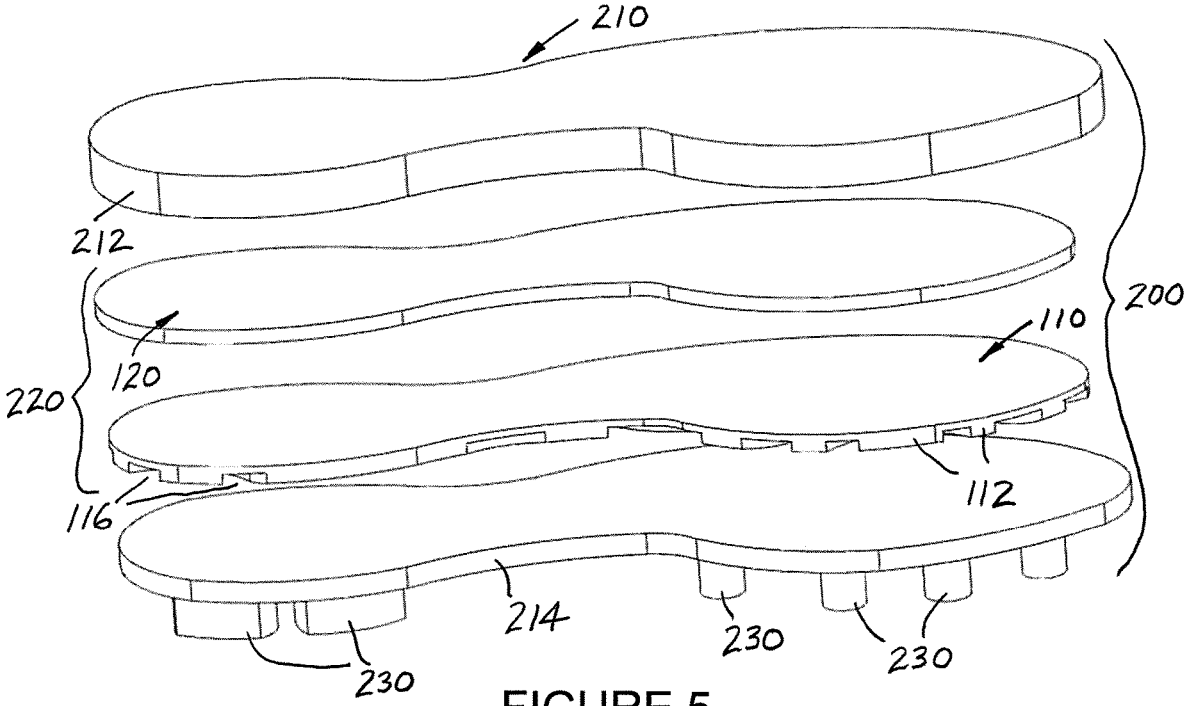
Figure 6:
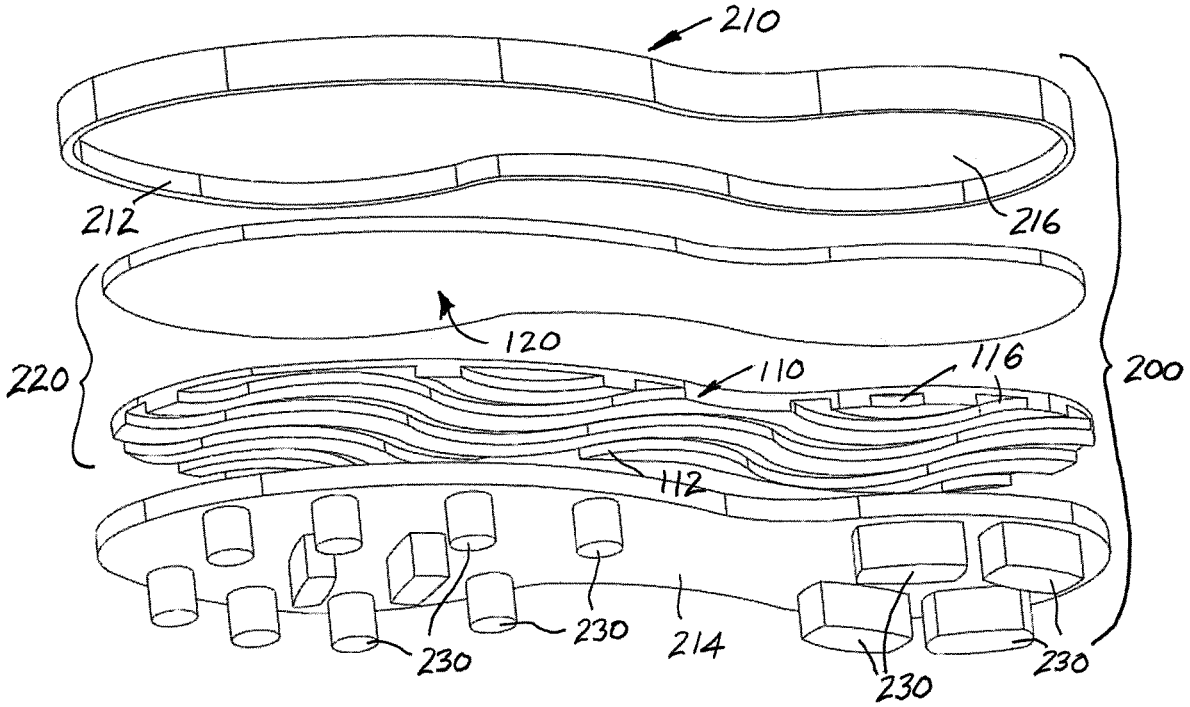

An outsole or outsole assembly 200 shown in FIGS. 4-6 for an athletic shoe incorporates an assembly structurally similar to the insole 100 of FIGS. 1-3 into the outsole. The outsole 200 includes a first layer or support layer 210 provided below the sole. Preferably the first layer 210 extends under an entirety of the sole and has a perimeter akin to a footprint. The first layer 210 is preferably a smooth, unbroken surface made of lightweight plastic, with a thickness ranging between 1/12" and ⅛", and more preferably on the order 1/10". Along the perimeter of first layer 210 is a sidewall or sidewall portions 212 that extend downwardly from a perimeter of the first layer to connect layer 210 to a second layer 214. As evident in FIGS. 4 and 6, sidewall portions 212 extend over the perimeter of the first and second layers 210 and 214, creating an empty space or cavity 216 between the first and second layers 210 and 214. The height of the sidewall portions 212 (and thus the space between the layers 210 and 214) is a dimension ranging between ⅓" and ¾", and more preferably on the order ½". The thickness of sidewalls 212 is a dimension ranging between ⅛" and ½" and more preferably on the order ¼". The first and second layers 210 and 214, as well as sidewall portions 212 are preferably made of the same lightweight plastic and ideally would be made from a single mold of plastic.

An assembly 220 (virtually identical to the insole 100 described in connection with FIGS. 1-3) is placed between the first and second layers 210 and 214 and within sidewall portions 212, i.e. within the cavity or space 216 between the layers. One difference in the assembly 220 of FIGS. 4-6 relative to the insole described in connection with FIGS. 1-3 would be the height and width, which would be based on the cubic space between the first and second layers 210 and 214. For purposes of brevity, and ease of illustration and understanding, like reference numerals are used to illustrate the assembly 220 (although it will be appreciated that this assembly 220 is part of the outsole and is not an insole 100 of the athletic shoe).

Ideally, tread, studs, spikes 230 for the athletic shoe are provided in the second layer 214 and would preferably be molded from the same plastic mold as the assembly of outsole 200 and would extend downward toward the ground surface from the underside of layer 214.

Below is a table of various materials and substances with their respective thermal conductivity where thermal conductivity, k–W/(m·K), is conductive heat transfer vs. radiant heat transfer.

| MATERIAL | THERMAL CONDUCTIVITY (W/m * k) |
|---|---|
| perlite, vacuum | 0.00137 |
| silica aerogel | 0.02 |
| air, atmosphere | 0.024 |

-continued

| MATERIAL | THERMAL CONDUCTIVITY (W/m * k) |
|---|---|
| plastics, foamed | 0.03 |
| Styrofoam | 0.033 |
| felt insulation | 0.04 |
| fiberglass | 0.04 |
| corkboard | 0.043 |
| cork, regranulated | 0.044 |
| cork | 0.07 |
| medium cellular silicone | 0.09 |
| firm cellular silicone | 0.11 |
| rubber | 0.13 |
| stainless steel | 16 |
| iron, cast | 55 |
| Mylar | 57.77 |
| silver | 429 |

A preferred substance for this insole would have a low thermal conductivity with a particular durability to withstand normal use within a shoe. Thus, from this list, steel, iron, Mylar and silver materials have a substantially high thermal conductivity in comparison to the other listed materials which are more preferred. Rather, these materials are listed to give a range and understanding of thermal conductivity.

Testing Results

Testing for an embodiment was conducted using an electric hotplate in a controlled environment. The stovetop maintained a consistent temperature range of 175-185 F. Preliminary testing for this insole used a variety of heat resistant fabrics and materials, such as high and low density cork, firm and medium cellular silicon, high temperature fiber-glass substrates (commercially available under the tradenames Design Engineering Inc. or DEI Under Carpet Lite), high temperature fiberglass material with reflective aluminized Mylar (commercially available under the tradename DEI aluminized heat barrier), oxidized polyacrylonitrile (PAN) fibers (commercially available under the tradenames CarbonX, Koolmat felt, DJ-1, DJ-77), textured aluminum face with glass-fiber composite cores (commercially available under the tradename DEI Floor and Tunnel Shield), Mylar composites with a high temperature silica felt center (commercially available under the tradename Koolmat Shiny), heavy acrylic coated fiberglass (commercially available under the tradename Steiner BlackFlex), and woven silicon fiberglass composites (commercially available under the tradenames Koolmat or Koolmat Lite) to determine which would be the most effective at preventing heat transfer. Stock insoles for various soccer cleats were also tested for comparison.

Below is a table listing the thermal conductivity of the samples and materials used in the testing.

| SAMPLES | EST. THERMAL CONDUCTIVITY (W/m * k) |
|---|---|
| CarbonX B6 | .031-.07 |
| CarbonX B03RC | .031-.07 |
| Koolmat felt ¼" | .031-.07 |
| Koolmat DJ-77 | .031-.07 |
| Koolmat DJ-1 | .031-.07 |
| Koolmat (3/16") | .04-.13 |
| Koolmat Lite (⅛") | .04-.13 |
| Koolmat Shiny | .04-57.77 |
| DEI Under Carpet Lite | .04-.4 |

-continued

| SAMPLES | EST. THERMAL CONDUCTIVITY (W/m * k) |
|---|---|
| DEI Floor & Tunnel Shield | .04-205 |
| DEI Alum. Heat Barrier | .04-57.77 |
| Steiner Blackflex | .04-.2 |
| Low density Cork | .04 |
| High density Cork | .07 |
| 3/16" corkboard | .043 |
| ½" charcoal cork | .07 |
| Firm cellular silicon | .11 |
| Medium cellular Silicon | .09 |

The first series of tests involved placing a sample on the hotplate for two minutes, measuring the temperature of the top (where the foot would be) every 30 seconds. Each sample was approximately 6.25 square inches. Below is the table listing the results of the first tests.

Heat Source: 175-185° F.

| | WITHOUT PRESSURE TOP TEMPERATURE AFTER (° F.) | | | | |
|---|---|---|---|---|---|
| Samples | 0:00 | 0:30 | 1:00 | 1:30 | 2:00 |
| CarbonX B6 | 71 | 108.5 | 130 | 128/130 | 128 |
| **CarbonX B03RC** | **66** | **102** | **107.4** | **110.6** | **116.6** |
| **Koolmat felt ¼"** | **67.4** | **99.7** | **103** | **105** | **108** |
| Koolmat DJ-77 | 68 | 125 | 130 | 137 | 139 |
| Koolmat DJ-1 | 68 | 129 | 135 | 136 | 139 |
| **Koolmat** | **66** | **87** | **98.3** | **103.5** | **115.8** |
| Koolmat Lite | 66 | 116.1 | 119.3 | 148.1 | 149 |
| **Koolmat Shiny** | **66** | **100.1** | **114.3** | **117.9** | **119.3** |
| **DEI Under Carpet Lite** | **65.2** | **71.6** | **75.9** | **83.9** | **85.9** |
| **DEI Floor & Tunnel Shield** | **64.9** | **81.5** | **93.5** | **102.2** | **107.1** |
| Dei Alum. Heat barrier | 65 | 142.8 | 151.8 | 154.9 | 153.3 |
| Steiner BlackFlex | 64.3 | 134.2 | 142.5 | 145.4 | 145.9 |
| ⅛" low dens. Cork | 67.6 | 112.5 | 121.6 | 123.4 | 126.2 |
| ⅛" high dens. Cork | 67.5 | 113.9 | 123.2 | 130.4 | 135 |
| **3/16" corkboard** | **68** | **83.3** | **105.5** | **109.6** | **113.2** |
| **¼" low dens. Cork** | **68.7** | **80.5** | **96.9** | **108.8** | **110.2** |
| **¼" high dens. Cork** | **69** | **75.8** | **91.7** | **96.1** | **102.1** |
| 1" semi rigid cork** | 66 | 65.5 | 65.8 | 66.1 | 67.1 |
| **½" charcoal cork** | **65.3** | **69.2** | **75.1** | **83.4** | **88.6** |
| **¼" firm silicon** | **66.6** | **72.4** | **87.1** | **102.4** | **110.7** |
| **¼" med. Silicon** | **66.9** | **70.1** | **83.2** | **92.9** | **98.4** |
| ⅛" firm silicon | 68 | 113.8 | 130.7 | 137.5 | 137.3 |
| ⅛" med. Silicon | 67.4 | 113 | 131.6 | 133.6 | 136.3 |
| Athletic shoe #1 insole | 67.3 | 93.7 | 110.5 | 120.9 | 123.5 |
| Athletic shoe #2 insole | 68.1 | 82.3 | 94.8 | 105.2 | 109.8 |
| Athletic shoe #3 insole | 68.2 | 84.3 | 98.3 | 112.3 | 117.1 |

**Although the top temperature was the lowest, this sample was discarded because the thickness of the material is not deemed feasible for an insole or outsole model.

From this set of data, the samples that performed the best (highlighted in bold) were measured again with constant pressure for an additional two minutes and readings taken at 30 second intervals. Pressure was applied to the samples to simulate the environment within an insole, which would certainly endure constant pressure from a foot. To simulate the surface that would be applying pressure to the insole (foot), a hand pressed down on the samples with an average force of 2.5 pounds per square inch, or approximately 16 pounds for the entire sample. This number was found by taking the average weight of a person, 180 lbs, dividing it by two (for each foot), and again dividing it by 35 square inches (average surface of the bottom of a foot). This number, 2.57, is the amount of pounds per square inch of force that is exerted on the ground, or insole, by one foot, assuming equal distribution of weight throughout a foot. To find out how much force should be applied to a 6.25 square inch sample, 2.57 was multiplied by 6.25 (size of sample). A scale was used to insure consistency of weight applied by the hand. Below is a table listing the results of the pressure tests.

| Heat Source: 175-185° F. | | | | | |
|---|---|---|---|---|---|
| | WITH PRESSURE TOP TEMPERATURE AFTER (° F.) | | | | |
| Samples | 0:00 | 0:30 | 1:00 | 1:30 | 2:00 |
| CarbonX B03RC | 68 | 106.4 | 108.5 | 114 | 115.3 |
| Koolmat felt ¼" | 67.3 | 102 | 107.5 | 113.7 | 114.8 |
| Koolmat | 67 | 119.6 | 138.2 | 141.9 | 144.2 |
| Koolmat Shiny | 68 | 99.3 | 105.6 | 110.3 | 111.3 |
| DEI Under Carpet Lite* | 68.2 | 89.1 | 93.3 | 97 | 102.3 |
| DEI Floor & Tunnel Shield | 67.9 | 91.4 | 101.4 | 103.2 | 106.8 |
| 3/16" corkboard | 66.9 | 92.4 | 108.3 | 108.9 | 111 |
| ¼" high dens. Cork | 66.5 | 89.7 | 99.3 | 99.8 | 102.1 |
| ¼" low dens. Cork | 66.7 | 89.2 | 97.4 | 100.1 | 105.2 |
| ½" charcoal cork* | 65.9 | 83 | 86.1 | 88.3 | 95.3 |
| ¼" firm silicon | 67 | 86.1 | 94.6 | 98.5 | 100.1 |
| ¼" med. Silicon | 67 | 83.8 | 90.6 | 95 | 97.4 |
| Athletic shoe #1 insole | 68 | 122.8 | 130.4 | 132.8 | 134.3 |
| Athletic shoe #2 insole | 68.1 | 87.3 | 94.5 | 111.4 | 117.2 |
| Athletic shoe #3 insole | 68.3 | 89.1 | 96.2 | 114.8 | 122.4 |

*Realistically, a material of this thickness and/or rigidity would not be ideal for use in an athletic shoe or cleat.

The results appear surprising at first; i.e., it appears the samples perform better with pressure, which seems to defy logic. Upon further investigation, it was concluded that the hand that applied pressure absorbed some of the heat from the sample being tested, which led to slightly cooler results. However, the trends of what samples worked the best certainly remained true. Also, some of the samples, including Koolmat and the three athletic shoes #1, #2, and #3 insoles performed significantly worse.

The stock athletic shoes #1 and #2 insoles both exceeded 122° F. in just two minutes. Per findings of various studies (HC, EHP), contact with a surface of a temperature over 122° F. can burn skin in less than 10 minutes. Because the insoles of the athletic shoes exceed 122° F. in an environment that simulates a hot day on turf, athletes using such insoles expose themselves to potential blistering and burning during practice and games.

The materials that performed the best were firm and medium cellular silicon and medium and low density cork. While the temperatures of these samples were significantly lower than the stock insoles, further tests were done using a combination of materials and samples to see if lower temperatures could be achieved. Tests were again done using a combination of heat resistant felt (made of oxidized PAN fibers) and the four samples that performed the best in the pressure test. Channels were also carved into additional samples of the high and medium density cork and silicon of the same size (6.25 square inches), which were to be tested independently as well as in combination with the felt.

Identical two minute tests were done, one without pressure and one with pressure, measuring the top temperature every 30 seconds. The following were tested in this series of tests: ¼" firm and medium cellular channeled silicon with downward*facing channels, ¼" firm and medium cellular non-channeled silicon with felt on the top/bottom, ¼" firm and medium cellular channeled silicon with upward facing channels and heat resistant felt on top, and ¼" firm and medium cellular channeled silicon with downward facing channels and heat resistant felt on the top/bottom. Cork was not tested because it was evident that silicon performed better and was a more viable material to be used because of its durability. However, any material similar to silicon or cork (i.e. similar thermal properties, elasticity, density, etc.) should be expected to perform similarly. The oxidized PAN fiber felt that was used was the Koolmat felt because it performed the best of all the similar felts. Below is a table listing the results of the tests.

Silicon with upward facing channels was not documented by itself because the temperature was drastically higher within the channels than it was on the ridges of the channels as the space within the channels was much closer to the hotplate.

| Heat Source: 175-185° F. | | | | | |
|---|---|---|---|---|---|
| | WITHOUT PRESSURE TOP TEMPERATURE AFTER (° F.) | | | | |
| Samples | 0:00 | 0:30 | 1:00 | 1:30 | 2:00 |
| ¼" firm silicon, channels down | 68.1 | 75 | 96.5 | 107.3 | 114.8 |
| ¼" med silicon, channels down | 68 | 76.2 | 93.1 | 111.2 | 122.1 |
| ¼" med silicon, felt top | 67 | 81.8 | 84 | 87.3 | 91.3 |
| ¼" med silicon, felt bottom | 67.2 | 87.1 | 88.5 | 90.5 | 93 |
| ¼" firm silicon, felt top | 68.1 | 85.3 | 86.8 | 91.9 | 93.4 |
| ¼" firm silicon, felt bottom | 68.1 | 83.5 | 84.1 | 87 | 89.6 |
| ¼" med silicon, channels up, felt on top | 67.6 | 76.3 | 80 | 84.6 | 88.1 |
| **¼" med silicon, channels down, felt on top** | **67.6** | **80.2** | **81.1** | **84** | **86** |
| **¼" med silicon, channels down, felt on bottom** | **68.6** | **76.3** | **78.4** | **84** | **86.3** |
| ¼" firm silicon, channels up, felt on top | 68.2 | 76 | 80.2 | 84.6 | 88.5 |
| **¼" firm silicon, channels down, felt on top** | **68** | **79.8** | **81** | **84.4** | **86.4** |
| **¼" firm silicon, channels down, felt on bottom** | **68** | **76.5** | **79.3** | **84.1** | **86.6** |

As evident, a combination of the ¼" silicon with downward facing channels and heat resistant felt performed the best, significantly better than non-channeled silicon with the same felt.

The downward facing channeled silicon (firm and medium) by itself performed poorly, but when used in conjunction with the heat resistant felt above it, became the best combination (bold). This is attributed to the airspace created within the assembly by the channels in the silicon. Because there is about half as much surface area that comes into physical contact with the hotplate because of the channels, the amount of conductive heat transfer is reduced by half. It is therefore advantageous to have a channeled assembly of solid material, such as silicon, used in conjunction with heat resistant felt, preferably made of oxidized PAN fibers to reduce the amount of heat transferred to the foot from a hot ground surface.

An additional set of testing was done with the samples on the hotplate for a longer duration of time: six minutes. These tests involved placing the combination of materials and samples on the hotplate for six straight minutes, once with constant pressure and another with no pressure, to conclude what the maximum temperature would be in such an environment similar to a hot day on turf. The following samples were tested: ¼" firm and medium cellular non-channeled silicon with felt on the top/bottom, ¼" firm and medium cellular channeled silicon with downward facing channels and felt on the top/bottom, and ¼" firm and medium cellular channeled silicon with upward facing channels and felt on top. Also, athletic shoes #1, #2, and, #4 insoles were tested for comparison. Below is a table listing the results of these tests.

| 6 Min Test, constant pressure | Temperature after 6 mins (° F.) |
|---|---|
| **Athletic shoe #1 insole** | **144.6** |
| **Athletic shoe #2 insole** | **142.8** |
| **Athletic shoe #4 insole** | **134.2** |
| ¼" med silicon, felt top | 95.2 |
| ¼" med silicon, felt bottom | 102.5 |
| ¼" firm silicon, felt top | 97 |
| ¼" firm silicon, felt bottom | 106.1 |
| ¼" med silicon, channels up, felt on top | 101.1 |
| ¼" med silicon, channels down, felt on top | 94.3 |
| ¼" med silicon, channels down, felt on bottom | 93.2 |
| ¼" firm silicon, channels up, felt on top | 97.1 |
| ¼" firm silicon, channels down, felt on top | 97.6 |
| ¼" firm silicon, channels down, felt on bottom | 110.2 |

| 6 Min Test, no pressure | Temperature after 6 mins (° F.) |
|---|---|
| **¼" med silicon, channels down, felt on top** | **94.3** |
| **¼" med silicon, channels down, felt on bottom** | **93.2** |
| ¼" firm silicon, channels up, felt on top | 97.1 |
| ¼" firm silicon, channels down, felt on top | 97.6 |
| ¼" firm silicon, channels down, felt on bottom | 110.2 |

As evident, the ¼" medium cellular silicon with the downward facing channels performed the best in the six minutes. Because the athletic shoes #1, #2, and #4 insoles would always endure pressure when used in an athletic cleat, there was no need to test them without pressure. It is already evident that they exceed the threshold temperature of 122° F., above which skin burns in less than 10 firm and medium cellular channeled silicon with downward facing channels and felt on the top/bottom. Below is a table listing the results of these tests.

| 6 Min Test, no pressure | Temperature after 6 mins (° F.) |
|---|---|
| **¼" med silicon, channels down, felt on top** | **97.2** |
| **¼" med silicon, channels down, felt on bottom** | **98.9** |

-continued

| 6 Min Test, no pressure | Temperature after 6 mins (° F.) |
|---|---|
| ¼" firm silicon, channels down, felt on top | **99.2** |
| ¼" firm silicon, channels down, felt on bottom | 102.4 |

Again, the hand that applied the pressure absorbed some of the heat, but the trend is still the same. The reason that the IA" medium cellular channeled silicon with downward facing channels and felt on the bottom performed better than the firm cellular channeled silicon with downward facing channels and felt on top is because the medium cellular silicon has a lower thermal conductivity than the firm cellular silicon, as evident by their independent tests. The medium cellular channeled silicon with downward facing channels and heat resistant felt above it performs the best. This combination reaches a maximum top surface temperature of 97.2° F., 37 degrees cooler than the athletic shoe #4 insole, 45.6 degrees cooler than the athletic shoe #2 insole, and 47.4 degrees cooler than the athletic shoe #1 insole. 97.2° F. is 24.8 degrees cooler than the 122° F. threshold at which skin burns within 10 minutes. With this combination of silicon and heat resistant felt, athletes greatly reduce the risks of incurring burns and blisters while playing on hot turf.

Figure 7:
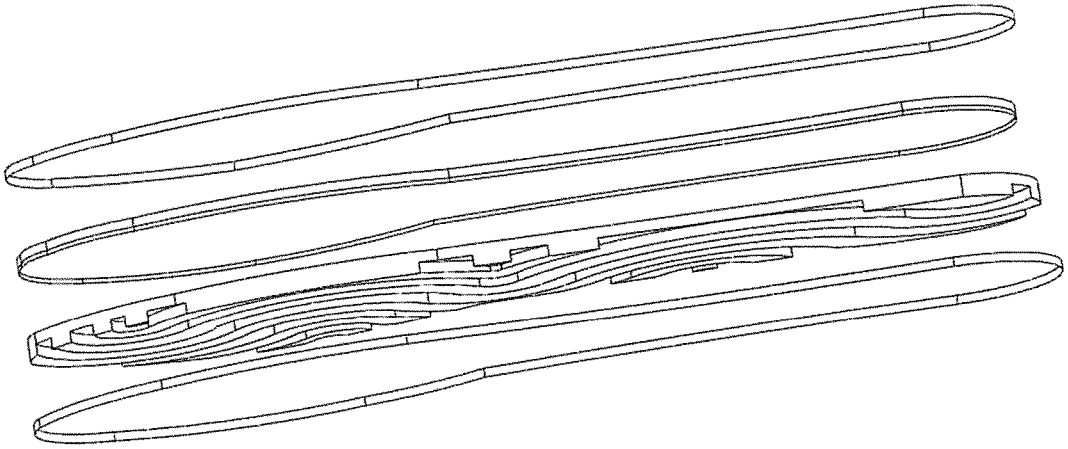
FIG. 7 illustrates another embodiment where the shoe portion includes four layers or components.

In another embodiment (FIG. 7), the shoe portion includes four layers or components (as opposed to the two layers shown in FIGS. 1-3 and the two layers incorporated into the outsole assembly of FIGS. 4-6). A first or bottom layer is an ethylene vinyl acetate, which is standard cushiony material that a lot of insoles are made out of. This is mainly for structure and support. Above that layer is the channeled material layer as described above, which, for this model, is made from commercially available Kao-tex textile 2000, but can be made out of a range of heat resistant materials such as described above. The design uses a material available from Morgan Thermal Ceramics: KaoTex 2000 that has a thermal conductivity of approximately 0.02 watts per meter Kelvin. The reason the value is an approximation is due to the tendency for thermal conductivities to change with increasing temperatures. It is believed that any material that falls within the bounds of 0.001-0.08 w/mK should be considered a suitable material comparable to the KaoTex 2000. Other materials may be considered as alternatives to the KaoTex 2000 if the selected material reacts similarly to pressure. For example, a product similar to a KaoTex product should be considered to have a density between 100-200 kilograms per meter cubed, a melting point greater than 1000 degrees Celsius, and/or an ability to retain thermal properties at 10 kilopascals (208.8 pounds per cubic foot). A third or supportive layer of ethylene vinyl acetate is provided above the second layer. Finally a fourth layer includes a thin, top layer or moisture wicking fabric. This four layer assembly can be substituted for the two layers shown and described in connection with FIGS. 1-6.

It will be appreciated that the teachings of the present disclosure need not be necessarily limited to the preferred use as an athletic use, but may also find application in other shoes such as construction boots and the like where extreme heat may be encountered.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

What is claimed is:

1. A shoe portion comprising:

a first layer having first and second surfaces extending outwardly therefrom in opposite directions, the first layer made of a first material having a low thermal conductivity throughout the first layer, and the first layer including channels extending inwardly from the first surface which is a lower surface of the first layer and terminating in the first layer without reaching the second surface, the channels extending longitudinally throughout the first layer from an anterior end to a posterior end, and from a medial side to a lateral side of the first layer, the channels are separated from one another and create air space therein in the first layer, and wherein the second surface of the first layer is an unbroken, continuous surface;

a second layer of heat resistant material abutting the first layer; and wherein the first and second layers have a same perimeter outline and form at least a portion of either an insole or an outsole of a shoe, the portion including the channels facing downwardly in a direction away from the second layer.

2. The shoe portion of claim 1 wherein the channels face downwardly away from the second layer.

3. The shoe portion of claim 1 wherein the channels have a curvilinear configuration.

4. The shoe portion of claim 1 wherein the heat resistant material second layer is a felt.

5. The shoe portion of claim 4 wherein the felt includes fibers for limiting heat transfer.

6. The shoe portion of claim 5 wherein the fibers include oxidized polyacrylonitrile fibers.

7. The shoe portion of claim 1 wherein the channels extend inwardly from the second surface toward the first surface of the first layer by a dimension of approximately one-half of a total thickness of the first layer.

8. The shoe portion of claim 1 wherein the channels have a depth approximately one-eighth of an inch (⅛").

9. The shoe portion of claim 1 wherein the channels have a width of ranging from one-tenth of an inch to one-sixth of an inch (1/10"-⅙").

10. The shoe portion of claim 1 wherein the channels are spaced apart by a dimension ranging from one-tenth of an inch to one-sixth of an inch (1/10"-⅙").

11. The shoe portion of claim 1 wherein the first and second layers form an insole of the shoe.

12. The shoe portion of claim 11 wherein the insole is configured to be removable from a shoe.

13. The shoe portion of claim 11 wherein the insole is configured to be secured to an interior of a shoe.

14. The shoe portion of claim 1 wherein the first and second layers form a portion of an outsole of the shoe.

15. The shoe portion of claim 14 wherein the outsole includes an upper layer having an unbroken surface, and a lower layer having an unbroken surface spaced from the upper layer and forming a cavity therebetween, the first and second layers received in the cavity.

16. The shoe portion of claim 14 wherein the shoe includes one of treads, spikes, studs or cleats on an outwardly facing surface of the outsole.

17. The shoe portion of claim 1 in combination with a shoe having both an insole and an outsole that each includes a first layer of heat resistant material; and a second layer beneath the first layer and made at least in part of a material having a low thermal conductivity and including plural channels on one of a first and second surfaces thereof.

18. A method of making a shoe portion comprising:

providing a first layer having first and second surfaces extending outwardly therefrom in opposite directions, wherein the first layer is made entirely of a first material having a low thermal conductivity;

including plural channels on the first surface of the first layer extending longitudinally throughout the first layer from an anterior end to a posterior end, and from a medial side to a lateral side of the first layer, where the channels separated from one another and creating air space therein, terminating a depth of the channels into the first surface which is a lower surface of the first layer so that the channels only extend partially though the first layer and thereby create air space in the first layer, maintaining an unbroken, continuous surface of the second surface of the first layer;

supplying a second layer of heat resistant material;

forming the first and second layers to have a same perimeter outline; and assembling the first layer beneath the second layer in the shoe portion, whereby the first and second layers form a portion of either an insole or an outsole of a shoe, and the channels facing downwardly in a direction away from the second layer.

* * * * *